US012747507B2

(12) United States Patent
Bulan et al.

(10) Patent No.: US 12,747,507 B2
(45) Date of Patent: Sep. 29, 2026

(54) PRODUCTION OF CHLORINE, CARBON MONOXIDE AND OPTIONALLY HYDROGEN

(71) Applicant: COVESTRO INTELLECTUAL PROPERTY GMBH & CO. KG, Leverkusen (DE)

(72) Inventors: Andreas Bulan, Langenfeld (DE); Juergen Kintrup, Emsdetten (DE); Alexander Lueken, Kaarst (DE)

( * ) Notice: Subject to any disclaimer, the term of this patent is extended or adjusted under 35 U.S.C. 154(b) by 1151 days.

(21) Appl. No.: 17/766,266

(22) PCT Filed: Oct. 7, 2020

(86) PCT No.: PCT/EP2020/078057
§ 371 (c)(1),
(2) Date: Apr. 4, 2022

(87) PCT Pub. No.: WO2021/069470
PCT Pub. Date: Apr. 15, 2021

(65) Prior Publication Data
US 2024/0084462 A1 Mar. 14, 2024

(30) Foreign Application Priority Data
Oct. 8, 2019 (EP) ..... 19201889

(51) Int. Cl.
*C25B 9/00* (2021.01)
*C25B 1/02* (2006.01)
(Continued)

(52) U.S. Cl.
CPC ..... *C25B 1/23* (2021.01); *C25B 1/02* (2013.01); *C25B 1/26* (2013.01); *C25B 11/032* (2021.01);
(Continued)

(58) Field of Classification Search
CPC ..... C25B 1/23; C25B 15/081; C25B 15/083; C25B 11/081; C25B 11/032; C25B 15/087; C25B 1/02; C25B 1/26
See application file for complete search history.

(56) References Cited

U.S. PATENT DOCUMENTS

2005/0000798 A1* 1/2005 Faita ..... C25B 9/19 205/466
2008/0250715 A1* 10/2008 Cooper ..... F23J 15/04 423/220
(Continued)

FOREIGN PATENT DOCUMENTS

DE 102017204096 A1 9/2018
DE 102017219974 A1 * 5/2019 ..... C25B 15/08
(Continued)

OTHER PUBLICATIONS

DE102017219974A1 machine translated (Year: 2019).*
(Continued)

*Primary Examiner* — Zulmariam Mendez
(74) *Attorney, Agent, or Firm* — K&L Gates LLP

(57) ABSTRACT

The invention relates to a method and an electrolysis device for the production of chlorine, carbon monoxide and optionally hydrogen via the electrochemical conversion of carbon dioxide and alkali chloride solution, wherein the carbon dioxide from a carbon dioxide gas source (55) is electrochemically reduced at a gas diffusion electrode, designed as a cathode (11), in an aqueous alkali-chloride-containing solution as the catholyte (17), and chlorine is simultaneously anodically generated from an aqueous alkali-chloride-containing solution as the anolyte (15*a*).

21 Claims, 2 Drawing Sheets

(51) Int. Cl.

| | |
|---|---|
| ***C25B 1/23*** | (2021.01) |
| ***C25B 1/26*** | (2006.01) |
| ***C25B 11/032*** | (2021.01) |
| ***C25B 11/081*** | (2021.01) |
| ***C25B 15/08*** | (2006.01) |

(52) U.S. Cl.
CPC ..... *C25B 11/081* (2021.01); *C25B 15/081* (2021.01); *C25B 15/083* (2021.01); *C25B 15/087* (2021.01)

(56) References Cited

U.S. PATENT DOCUMENTS

| | | | | |
|---|---|---|---|---|
| 2014/0131217 | A1* | 5/2014 | Buschmann | C01B 11/062 205/633 |
| 2018/0195184 | A1* | 7/2018 | Fleischer | C25B 15/083 |

FOREIGN PATENT DOCUMENTS

| | | | |
|---|---|---|---|
| EP | 1728896 | A2 | 12/2006 |
| EP | 2398101 | A1 | 12/2011 |
| JP | 2017210666 | | 11/2017 |
| WO | 97/19205 | A1 | 5/1997 |
| WO | 2005/012595 | A1 | 2/2005 |
| WO | 2012/079670 | A1 | 6/2012 |
| WO | 2020/057998 | A1 | 3/2020 |

OTHER PUBLICATIONS

Verma, et al., "The effect of electrolyte composition on the electroreduction of $CO_2$ to CO on Ag based gas diffusion electrodes", Phys. Chem. Chem. Phys., 2016, 18, pp. 7075-7084.

International Search Report and Written Opinion received for PCT Patent Application No. PCT/EP2020/078057, mailed on Mar. 4, 2021, 20 pages (4 pages of English Translation and 16 pages of Original Document).

* cited by examiner

PRODUCTION OF CHLORINE, CARBON MONOXIDE AND OPTIONALLY HYDROGEN

CROSS-REFERENCE TO RELATED APPLICATIONS

This application is a national stage application (under 35 U.S.C. § 371) of PCT/EP2020/078057, filed Oct. 7, 2020, which claims benefit of European Application No. 19201889.3, filed Oct. 8, 2019, both of which are incorporated herein by reference in their entirety.

The invention relates to a process and to an electrolysis device for production of chlorine, carbon monoxide (CO) and optionally hydrogen by electrochemical conversion of carbon dioxide ($CO_2$) and alkali metal chloride solution.

What are more particularly described are a process for sustainable preparation of raw materials for isocyanate production, and an electrolysis apparatus and the operation thereof for simultaneous preparation of carbon monoxide and chlorine and optionally hydrogen, and the recycling of hydrogen chloride as by-product from isocyanate production.

At present, the commodity chemicals carbon monoxide and synthesis gas, consisting of carbon monoxide and hydrogen, are typically produced from fossil raw materials. Owing to increasing scarcity of fossil raw materials and $CO_2$ emissions associated with the production of carbon monoxide, there is a need for sustainable synthesis routes, firstly in order to conserve fossil resources such as natural gas or mineral oil, and secondly in order to avoid $CO_2$ emissions that are generated as a result of incineration on disposal of the products produced from said commodity chemicals if not earlier, and the resulting global heating.

It is additionally advantageous to use $CO_2$ from other sources as raw material for the synthesis. This avoids the release of $CO_2$ from various processes, for example steelmaking or refuse incineration. This could slow the rise of global heating via $CO_2$ emission from such $CO_2$ sources.

By utilization of renewable energy, for example electrical power from wind energy, hydro power or solar power plants, particularly in combination with utilization of $CO_2$ as chemical raw material, the preferred novel process described hereinafter is a particularly sustainable process for producing isocyanates.

Thus, electrolysis processes are particularly suitable for sustainable production of commodity chemicals such as CO.

Since commodity chemicals for plastics production are typically produced on a 1000-tonne scale, electrolysis processes for production of commodity chemicals must also be developed on a large industrial scale (1000 t/a). In order to produce industrial-scale amounts of product by electrolysis processes, large-area electrolysis cells and electrolyzers with a large number of electrolysis cells are needed. Industrial production volumes are understood here and hereinafter to mean amounts of product with more than 0.1 kg/(h*m$^2$) per electrolysis cell. For this purpose, as is known from chloralkali electrolysis, electrolysis cells with an electrode area of more than 2 m$^2$ per electrolysis cell are typically used. The electrolysis cells are combined in groups of up to 100 in an electrolysis frame. Multiple frames then form an electrolyzer. The capacity of an industrial electrolyzer is currently up to 30 000 t/a of chlorine and the respective equivalents of sodium hydroxide solution or hydrogen.

The utilization of a gas diffusion electrode (GDE) for the cathodic reduction of oxygen is already known for the performance of a chloralkali electrolysis.

However, industrial scale processes for electrochemical reduction of $CO_2$ are currently unknown, as is the combination of electrochemical reduction of $CO_2$ to CO and the simultaneous preparation of chlorine.

Typically, the preparation of isocyanates affords hydrogen chloride, which can be recycled back to chlorine by gas phase oxidation with oxygen or can be converted to hydrogen chloride after absorption in water, and converted to chlorine and hydrogen or to chlorine and water by electrolysis.

Typically, carbon monoxide is currently produced from fossil raw materials such as natural gas or coal.

Electrolysis processes using $CO_2$ as raw material are known in principle, the electrochemical reduction of which affords CO. A disadvantage here is found to be that the electrolysis processes use hydrogencarbonate-containing electrolytes, a high superstoichiometric amount of $CO_2$ is supplied, and hence a high separation intensity is needed for separation of carbon dioxide from the gas mixtures produced, or from the electrolyte. Furthermore, in known processes, oxygen or an oxygen-$CO_2$ gas mixture is produced at the anode, which has to be separated in a complex manner. This $CO_2$ escapes with the $O_2$ and has to be replaced, which has an adverse effect on the economic viability of such known processes.

Furthermore, the electrical conductivity of carbonate-containing electrolytes is comparatively low, which results in a high electrolysis voltage for the $CO_2$ electrolysis. The high electrical energy consumption also significantly impairs the economic viability of such a process.

Furthermore, it is not possible in many cases to find a viable industrial utilization for the further oxygen product from the known $CO_2$ electrolysis, which means that the energy introduced for the electrolysis cannot be utilized efficiently.

It is additionally known that the anodic production of oxygen proceeds with high overvoltage, which also adversely affects the efficiency of the known process. Also formed at the anode in the evolution of oxygen are protons, which can drive $CO_2$ out of the carbonate-containing electrolyte. This $CO_2$ firstly disrupts the electrolysis in that the $CO_2$ gas bubbles worsen the conductivity of the electrolyte and collect on the surface of the anode and hinder the access of electrolyte. Both lead to higher cell voltages. Furthermore, the $CO_2$ formed has to be separated from the $O_2$ if the oxygen is to be used further. However, the $CO_2$ driven out must be recycled again for such a procedure to be sustainable.

The loss of $CO_2$ must generally be avoided since it is a raw material that has to be provided in a complex manner in some cases.

The problem addressed was that of providing a process that does not have the abovementioned disadvantages of known procedures.

The invention provides a process for preparing chlorine, carbon monoxide and optionally hydrogen by electrochemical reaction of carbon dioxide and alkali metal chloride solution, characterized in that the carbon dioxide is electrochemically reduced at a gas diffusion electrode as cathode in an aqueous alkali metal chloride-containing solution as catholyte and, at the same time, chlorine is produced anodically from an aqueous alkali metal chloride-containing solution as anolyte, where the alkali metal salt of carbonic acid formed in the catholyte, selected from alkali metal carbonate, alkali metal hydrogencarbonate or mixtures thereof, is then reacted with hydrogen chloride to give carbon dioxide and alkali metal chloride, and the carbon dioxide released is returned to the cathode space for the gas diffusion electrode and the alkali metal chloride produced is returned either to the anode space and/or to the cathode space.

In the process of the invention, an alkali metal chloride-containing electrolyte is used, both in the anode space and in the cathode space. Alkali metal chloride is especially understood to mean sodium chloride or potassium chloride, and possibly also cesium chloride. Particular preference is given to using potassium chloride. At the anode, chlorine gas is produced from the alkali metal chloride-containing electrolyte and, at the same time, $CO_2$ is reduced to carbon monoxide, and hydrogen may be produced.

It is an advantage of the new process that no oxygen or oxygen-$CO_2$ mixture is formed at the anode, but rather chlorine in high purity, as fundamentally known from chloralkali electrolysis.

The $CO_2$ reduction is likewise effected from alkali metal chloride-containing electrolyte. The great advantage over the carbonate- or hydrogencarbonate-containing electrolyte systems is that, firstly, there is higher conductivity of the electrolyte and no $CO_2$ gas is released at the anode, which disrupts the electrolysis process, i.e. leads to higher electrolysis voltages and has to be separated again from the anode gas.

However, the hydroxide ions obtained at the cathode in the $CO_2$ reduction react with the carbon dioxide supplied to the cathode to give alkali metal salt of carbonic acid, selected from alkali metal carbonate, alkali metal hydrogencarbonate or mixtures thereof. The alkali metal salt of carbonic acid formed is in dissolved form in the catholyte. The process parameters are especially designed such that essentially alkali metal carbonate is formed, for example by the operation of the $CO_2$ electrolysis at elevated temperature. This has the advantage of higher solubility and avoids crystallization of alkali metal hydrogencarbonate or alkali metal carbonate in the pores of the gas diffusion electrode.

What is thus especially important for a preferred process is the control of the electrolyte temperatures, especially preferably the temperature of the catholyte. The temperature control is preferably chosen such that the catholyte temperature in the feed to the at least one electrolysis cell of the electrolysis apparatus is at least 60° C., especially preferably at least 70° C. This additionally increases the conductivity of the electrolytes and lowers the electrolysis voltage, which means that the process can be conducted in a more economically viable manner.

In the preferred execution of the invention, therefore, the temperature of the catholyte in the feed to the electrochemical reaction is at least 60° C., especially preferably at least 70° C.

The electrochemical conversion of carbon dioxide and catholyte, especially alkali metal chloride solution, at the cathode is especially effected such that the carbon dioxide gas is electrochemically reduced at a gas diffusion electrode as cathode in the presence of catholyte, and said catholyte is guided along the surface of the gas diffusion electrode by the principle of a falling liquid film.

The principle of a falling liquid film (usually also called falling film) says that a liquid, for example the catholyte here, is configured essentially by the action of gravity of a moving film. The liquid here is preferably guided as a film within a gap between two surfaces in a parallel arrangement that functions as electrolyte space. In the context of this preferred embodiment of the present invention, one of these surfaces forms a gas diffusion electrode, along the gap-facing two-dimensional electrode side of which the falling liquid film is conducted, and the other surface forms a two-dimensional separator, especially a membrane (preferably an ion exchange membrane or a diaphragm).

The catholyte is further preferably guided as a falling liquid film along the electrode surface of the gas diffusion electrode, where the flow velocity of the falling liquid film can be controlled by a flow retarder.

Particular advantages are obtained by the coupling of the novel process to other industrial chemical production processes in which chlorine is required as reactant and hydrogen chloride is obtained as by-product. Examples of such chemical processes are the production of isocyanates or of polyvinylchloride.

A preferred execution of the novel process is consequently characterized in that the hydrogen chloride is taken from a connected process for preparing isocyanates via phosgene as intermediate, and the chlorine formed in the electrochemical reaction is recycled into the phosgene production as precursor for isocyanate production.

The hydrogen formed together with CO as optional by-product of the electrochemical conversion in the novel process, in a preferred execution of the novel process, is separated from the mixture of hydrogen, CO and $CO_2$ and utilized.

The hydrogen is most preferably utilized for production of diamines from corresponding dinitro compounds as precursor for the isocyanate production process.

A further preferred execution of the novel process is characterized in that the concentration of the alkali metal chloride solution of the anolyte and/or of the catholyte is independently up to 25% by weight, preferably from 15% to 25% by weight.

In the novel process, in the case of operation on an industrial scale (i.e. at a conversion of at least 0.1 $CO_2$ kg/(h*m$^2$) (i.e. of at least 0.1 kg of $CO_2$ per hour and per square meter of electrode area)), the electrochemical conversion of $CO_2$ is conducted by the membrane electrolysis method at a gas diffusion electrode as cathode.

In this preferred variant of the novel process, the $CO_2$ is fed to the gas diffusion electrode via a gas space divided from the electrolyte space by the gas diffusion electrode.

The gas velocity in the gas space close to the reverse side of the gas diffusion electrode, in a particularly preferred execution of the aforementioned procedure, is from 0.001 to 15 m/s, preferably from 0.01 to 10 m/s.

The preferred process with a gas diffusion electrode is also independently characterized in that the drift velocity of the catholyte in the interspace between ion exchange membrane and gas diffusion electrode is from 0.8 to 10 cm/s.

The electrochemical conversion of $CO_2$ in an electrolysis apparatus, as described above, is effected at a gas diffusion electrode connected as the cathode and by the reaction specified hereinafter by way of example:

$$CO_2 + H_2O + 2e^- \rightarrow CO + 2OH^-$$

In a side reaction, as well as the carbon monoxide formed according to the above equation, hydrogen can also be produced.

At the anode, chlorine is evolved from an aqueous alkali metal chloride solution at commercial anodes known from chloralkali electrolysis, preferably at anodes composed of titanium bearing a ruthenium, titanium or iridium oxide coating (e.g. DSA coating, from Denora, Germany).

For the electrochemical conversion of $CO_2$ on the production scale, in particular, a large-area gas diffusion electrode is used, and, for the operation of the gas diffusion electrode, a cell construction in industrial size is used, it being necessary to take particular measures under some circumstances for operation in industrial electrolysis apparatuses.

For instance, in the case of industrial utilization of gas diffusion electrodes (GDEs), it should be noted that gas diffusion electrodes have an open-pore structure and are installed between electrolyte space and gas space. The structure of the GDE must enable reaction of the reactant gas ($CO_2$ here) at the three-phase boundary between electrolyte, catalyst and gas, as close as possible to the electrolyte. This boundary layer is stabilized by the hydrophobicity of the GDE material. However, it is found that this stabilization that results solely from the surface tension of the electrolyte permits merely a finite pressure gradient between the gas side and liquid side of the GDE. If the pressure on the gas side is too high, the gas ultimately breaks through the GDE, and the function of the GDE in this region is disrupted, meaning that electrolysis operation is locally interrupted here. If, on the other hand, the liquid pressure is too high, the three-phase boundary is shifted out of the catalyst region of the GDE to such an extent that the GDE is flooded with electrolyte and, if the pressure increases further, this results in breakthrough of electrolyte liquid into the gas space. This likewise disrupts the function of the GDE.

In the case of vertical electrode arrangement, which is sensibly employed in the case of electrolyses performed industrially, this leads to limitation of the construction height of the cell elements owing to the incapability of operation of known gas diffusion electrodes at excessively high gas pressure or liquid pressure. Industrial build heights in the case of vertical GDE arrangement are especially more than 30 cm, typically 100 to 150 cm. Even in the case of a build height of more than 10 cm in the upper region of the electrolyzer, gas from the gas space would penetrate into the cathode electrolyte gap between GDE and membrane. The industrially achievable build height would therefore be limited to about 20 to 30 cm, which does not permit industrially economic utilization for the electrolyzer constructions that are nowadays customary on the market.

There are no available cell concepts to date for the industrial electrochemical reduction of $CO_2$. Experiments are currently being conducted only on a small laboratory cell scale, with build height of less than 10 cm, and hence the problem of build height and a pressure differential between the gas space and the electrolyte space is not yet manifested.

A particular problem addressed by the present invention was therefore also that of operating the novel electrolysis method with a gas diffusion electrode, in which $CO_2$ is converted on an industrial scale at the GDE. An industrial scale is understood to mean production volumes such that more than 0.1 $CO_2$ kg/(h*m$^2$) is converted electrochemically.

As already mentioned above, electrochemical $CO_2$ reduction to CO or to CO/$H_2$ mixtures differs fundamentally from the electrochemical $O_2$ reduction. In the case of $O_2$ reduction, hydroxide ions are formed from the oxygen gas; hence, a reduction in volume takes place in the reaction. The GDE consumes the oxygen, which results in a decrease in the partial pressure. The $CO_2$ reduction to CO, however, forms the equimolar gas volume of product (CO or CO/$H_2$ mixture) from the $CO_2$ gas and the catholyte, and no reduction in the partial pressure takes place. Under some circumstances, this requires a special mode of operation, especially on the cathode side of the electrolysis cell. These specific modes of operation are described in unpublished patent application PCT/EP2019/073789 $CO_2$ electrolyzers. These include the gas inlet (5) beneath the cathode half-shell and the gas outlet (6) above the cathode half-shell, which feed and drain the gas space (4) of the cathode. This avoids accumulation of the hydrogen or CO by-product that has a lower density than $CO_2$. Furthermore, a high gas velocity and a defined electrolyte velocity should be established in order to achieve good performance.

There are also no known industrial electrolysis processes and electrolysis apparatuses known to date with which industrial-scale volumes of CO are producible from $CO_2$ in combination with the production of chlorine.

The invention therefore further provides an electrolysis apparatus for electrochemical conversion of carbon dioxide and alkali metal chloride solution, especially by the process of the invention as described above, at least comprising (i) at least one carbon dioxide gas source and (ii) at least one electrolysis cell, at least comprising a cathode half-shell having a cathode, a catholyte feed, a catholyte drain, and a gas space in fluid connection to the carbon dioxide gas source via a first gas inlet, and connected to a gas outlet for gaseous reaction product-containing gas, especially for a gas containing carbon monoxide, unconsumed carbon dioxide gas and optionally hydrogen, further comprising an anode half-shell, wherein the anode half-shell has been provided at least with a second gas outlet for the anode reaction product, especially chlorine and optionally oxygen, an anolyte feed for the introduction of an aqueous alkali metal chloride-containing solution as anolyte and an anolyte drain, and also an anode, and a separator disposed between the anode half-shell and cathode half-shell, for separation of anode space and cathode space, further comprising electrical power leads for connection of anode and cathode to a DC voltage source, wherein the cathode is designed as a gas diffusion electrode for conversion of carbon dioxide gas, and cathode, anode and the separator are arranged with their main extent vertically, and a gap as electrolyte space for passage of the catholyte by the principle of a falling liquid film is disposed between separator and cathode.

The separator in the novel electrolysis apparatus is preferably an ion exchange membrane or a diaphragm, more preferably an ion exchange membrane.

A preferred execution of the novel electrolysis apparatus is characterized in that the vertical main extent of the cathode is at least 30 cm, preferably at least 60 cm, more preferably at least 100 cm.

The cathode is a gas diffusion electrode designed for conversion of carbon dioxide gas.

In a preferred execution of the novel electrolysis apparatus, the cathode present in the at least one electrolysis cell is in a compact design as a gas diffusion electrode based on silver and/or silver oxide, preferably silver particles, as electrocatalyst and with a pulverulent fluoropolymer, especially PTFE powder, as nonconductive binder on a metallic or nonmetallic, conductive or nonconductive support. A particularly preferred gas diffusion electrode (GDE) for the $CO_2$ to CO reduction is a silver-based GDE analogous to the electrode described in EP2398101, with the variation described hereinafter.

The porosity of the catalytically active layer, calculated from material densities of the raw materials used, is especially more than 10%, but less than 80%.

The GDE is Specifically Produced by Way of Example as Follows:

3.5 kg of a powder mixture consisting of 5% by weight of PTFE powder, 88% by weight of silver(I) oxide and 7% by weight of silver powder (e.g. 331 type from Ferro) was mixed in an Eirich R02 mixer, equipped with a star-type agitator as mixing element, at a speed of 6000 rpm in such a way that the temperature of the powder mixture did not exceed 55° C. Overall, the mixing was conducted three times for a mixing time of 50 seconds and three times for a mixing time of 60 seconds. After the mixing, the powder mixture was sieved with a sieve having a mesh size of 1.0 mm. The sieved powder mixture was then applied to an electrically conductive support element. The support element was a silver wire mesh having a wire thickness of 0.14 mm and a mesh size of 0.5 mm. The application was effected with the aid of a template of thickness 2 mm, with application of the powder using a sieve having a mesh size of 1.0 mm. Excess powder that projected above the thickness of the template was removed by means of a scraper. After the template has been removed, the support with the powder mixture applied is compacted by means of a roll press at a compression force of 0.45 kN/cm. The gas diffusion electrode was removed from the roll press. The gas diffusion electrode had a porosity of about 50%.

The electrolysis apparatus is preferably designed such that the gas inlet for the carbon dioxide gas that leads to the cathode comprises an apparatus for control of the flow velocity, for example a control valve, that controls the velocity of the carbon dioxide gas in the gas space. The gas velocity controlled by means of this apparatus in the gas space close to the reverse side of the gas diffusion electrode, in a particularly preferred execution of the aforementioned electrolysis apparatus, is from 0.001 to 15 m/s, preferably from 0.01 to 10 m/s.

The electrolysis apparatus is preferably designed such that the drift velocity of the falling liquid film of the catholyte is regulated by a flow retarder. It is particularly preferable here when a flow retarder for the catholyte stream is provided in the gap, where the flow retarder preferably takes the form of an electrically nonconductive, chemically inert textile fabric.

The drift velocity of the catholyte in the interspace between separator and gas diffusion electrode, controlled by a flow retarder, in a particularly preferred electrolysis apparatus, is from 0.8 to 10 cm/s.

Most preferably, the electrolysis apparatus is designed such that the gas inlet for the carbon dioxide gas leading to the cathode comprises an apparatus for controlling the flow velocity, which controls the velocity of the carbon dioxide gas in the gas space, and that a flow retarder for the catholyte stream is additionally provided in the gap, where the flow retarder is preferably designed as an electrically nonconductive, chemically inert textile fabric. Particular preference is given here in each case to the aforementioned preferred values for the respective velocities.

Most preferably, the cathode present in the at least one electrolysis cell of the electrolysis apparatus is designed in compact form as a gas diffusion electrode based on silver and/or silver oxide, preferably silver particles, as electrocatalyst and with a pulverulent fluoropolymer, especially PTFE powder, as nonconductive binder on a metallic or nonmetallic, conductive or nonconductive support, wherein the gas inlet for the carbon dioxide gas leading to the cathode comprises an apparatus for controlling the flow velocity, which controls the velocity of the carbon dioxide gas in the gas space, and wherein a flow retarder for the catholyte stream is additionally provided in the gap, where the flow retarder is preferably designed as an electrically nonconductive, inert textile fabric. Particular preference is given here in each case to the aforementioned preferred values for the respective velocities.

If an electrolyzer contains multiple electrolysis cells, the electrolysis cells are preferably installed in a bipolar arrangement, such that only the respective end element is provided with a power connection. What is meant by a bipolar arrangement is that one anode half-shell is in contact with one cathode half-shell. The contact is via the metallic rear wall of the half-shells. A monopolar arrangement of multiple electrolysis cells in an electrolyzer is likewise conceivable; each element here has a separate power connection, the anode half-shell being connected to the plus pole of the rectifier and the cathode half-shell to the minus pole of the rectifier.

The reaction products formed by the electrolysis may respectively be removed as anode reaction product and as cathode reaction product through the above-defined gas outlets from the electrolysis cell of the electrolysis apparatus that are provided for the purpose.

Preferably, the first gas outlet in the novel electrolysis apparatus is connected at the upper end of the gas space and the second gas outlet at the upper end of the anode space, and the first gas inlet is connected at the lower end of the gas space.

A further preferred execution of the novel electrolysis apparatus is characterized in that the second gas outlet for the anode reaction product is connected via a collection pipe conduit and optionally a $Cl_2$ gas drying to a second gas separation unit for separation of oxygen from chlorine from the anode gas.

In a further preferred embodiment of the novel electrolysis apparatus, the first gas outlet is connected, especially via a collecting conduit, to a first gas separation unit for separation of carbon monoxide, hydrogen and unconsumed carbon dioxide gas.

In a further preferred embodiment of the novel electrolysis apparatus, the first gas separation unit has a recycle conduit for carbon dioxide gas separated off, which is especially connected via a distributor pipe conduit to the first gas inlet for carbon dioxide gas.

In a particularly preferred embodiment of the above-described novel electrolysis apparatus, the gas separation unit has an outlet for carbon monoxide separated off, connected to a chemical production plant for chemical conversion of carbon monoxide and chlorine to phosgene.

A particularly preferred execution of the novel electrolysis apparatus is characterized in that the catholyte drain and the anolyte drain are connected directly or indirectly via pipe conduits to an electrolyte collector, the electrolyte collector is provided via pipe conduit with a carbonate breakdown unit, and the carbonate breakdown unit at least with a recycle line for dissociated carbon dioxide, a controllable feed for hydrogen chloride and a recycle conduit for electrolyte, and the recycle conduit is connected both to the catholyte feed and to the anolyte feed.

The process of the invention enables a preferred process for sustainable production of isocyanates by electrochemical reduction of $CO_2$ to CO and simultaneous recycling of hydrogen chloride to give chlorine. Optional use of electrical energy from sustainably generated power is described more specifically and by way of example as follows.

For this purpose, an electrolyzer (see FIG. 1, electrolyzer 100) is equipped with a number of 80 to 100 electrolysis cells (see FIG. 1, electrolysis cells (Z)) per electrolyzer frame. An electrolysis cell has at least one anode half-shell and one cathode half-shell, anode and cathode, and reactant and product conduits and power connections (as shown with preference in FIG. 2 in schematic cross section). The electrolysis cells here are installed in a bipolar arrangement, such that only the respective end element is provided with a power connection. What is meant by a bipolar arrangement is that one anode half-shell is in contact with one cathode half-shell. The contact is via the metallic rear wall of the half-shells. A monopolar arrangement is likewise conceivable; each element here has a separate power connection, the anode half-shell being connected to the plus pole of the rectifier and the cathode half-shell to the minus pole of the rectifier.

In the context of a preferred embodiment, the electrolysis apparatus is capable of controlling the catholyte temperature, especially controlling it at at least 60° C., preferably at least 70° C. Preference is thus given to an electrolysis apparatus in which the catholyte feed comprises at least one heat exchanger for controlling the temperature of the catholyte to be fed to the at least one electrolysis cell.

The anode half-shell is supplied with an aqueous alkali metal chloride-containing solution as electrolyte (anolyte). In the anode half-shell, chlorine is produced from the aqueous alkali metal chloride solution. As a side reaction, a small amount of oxygen may be formed as well as the chlorine at the anode.

The pH of the alkali metal chloride solution which is supplied to the anode half-shell is more than pH 1.5.

The alkali metal chloride present in the anolyte is preferably at least one alkali metal chloride selected from the group of: cesium chloride, sodium chloride or potassium chloride, more preferably selected from sodium chloride or potassium chloride. Most preferably, potassium chloride is present in the anolyte.

A further preferred execution of the novel process is characterized in that the concentration of the aqueous alkali metal chloride solution of the anolyte is up to 25% by weight, preferably from 15% to 25% by weight. Most preferably, the potassium chloride concentration of the aqueous alkali metal chloride solution of the anolyte is up to 25% by weight, preferably from 15% to 25% by weight. The chlorine gas that still contains oxygen and water vapor is sent to a drying operation, for example by sulfuric acid drying, and then, depending on the oxygen content in the chlorine, to a chlorine gas separation. This can be effected, for example, by means of a liquefaction of the chlorine gas, especially by recuperative means. Accordingly, the chlorine gas can be compressed and liquefied, or sent to a chemical synthesis. A portion of the chlorine is sent to the synthesis of phosgene which is used for isocyanate production.

The anolyte, after leaving the electrolysis, is freed of active chlorine, i.e. chlorine of oxidation state greater than zero. This can be effected by a vacuum dechlorination and/or a chemical dechlorination, for example by addition of an alkali metal-containing bisulfite solution or of hydrogen peroxide.

After the dechlorination, the active chlorine content of the anolyte should especially be less than 20 ppm. The anolyte thus treated can be combined with the catholyte freed of CO and $H_2$. This may either precede or follow the alkali metal carbonate breakdown.

If bisulfite is used for dechlorination, potassium sulfate accumulates in the electrolyte. By partial discharge of electrolyte from the overall electrolyte circuit, in a preferred manner, the potassium sulfate content in the electrolyte can be kept constant. Preference is given to not exceeding a maximum concentration of potassium sulfate in the electrolyte of 10 g/L.

Anode half-shell and cathode half-shell are separated from one another by a separator, preferably by an ion exchange membrane. It is possible here to use commercial perfluorinated ion exchange membranes (such as membranes of the Asahi Glass F8080 type from Asahi or Chemours N2050 from Chemours). This prevents the chlorine produced at the cathode from being reduced again and any carbon monoxide produced at the cathode from being oxidized at the anode. Preference is likewise given here to avoiding mixing of chlorine with hydrogen or carbon monoxide, which is necessary for safety reasons.

In the cathode half-shell, carbon monoxide or a mixture of carbon monoxide and hydrogen is produced from $CO_2$ at a gas diffusion electrode, with additional production of hydroxide ions. The hydroxide ions react here with excess $CO_2$ to give carbonate ions, and in the presence of alkali metal ions to give alkali metal carbonate and/or alkali metal hydrogencarbonate.

The catholyte is guided via a collection pipe conduit to a gas removal in which any dissolved or dispersed CO or $CO/H_2$ gas mixture from the conversion of $CO_2$ is separated off. The separation can be effected, for example, by means of a stripping column with the aid of an inert gas. The stripped gas mixture is sent to an incineration. The cleaned catholyte is sent to an electrolyte collection apparatus or directly to an alkali metal carbonate breakdown unit.

The catholyte used here is likewise an aqueous solution of an alkali metal chloride. The alkali metal chloride which is sent to the anode half-shell and the cathode half-shell is preferably identical. It is possible to use sodium chloride, potassium chloride or cesium chloride, or mixtures thereof. Preference is given to sodium or potassium chloride, particular preference to potassium chloride.

More preferably, the concentration of the alkali metal chloride solution of the anolyte and/or of the catholyte is independently up to 25% by weight, preferably from 15% to 25% by weight.

After the separation of the gas mixture of carbon monoxide/optionally hydrogen/carbon dioxide taken from the cathode half-shell, carbon monoxide and the anodically produced chlorine are preferably sent to a phosgene synthesis. The phosgene produced here is used for the production of isocyanates, by reacting it with the appropriate amine. If the amine is prepared from a nitro compound, it can be reduced using any hydrogen that has been produced in the electrolysis and separated off.

The HCl gas obtained in the isocyanate production forms according to the following illustrative formula conversion

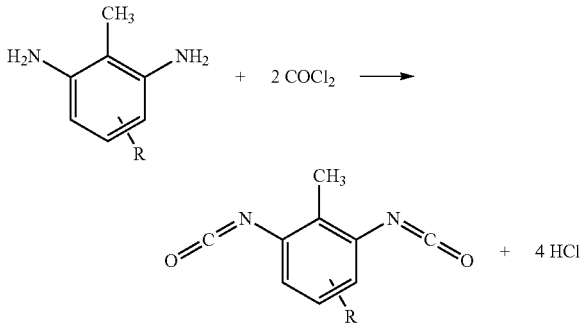

and is especially sent to the alkali metal carbonate breakdown unit. The alkali metal carbonate and possibly also alkali metal hydrogencarbonate formed from hydroxide ions and the $CO_2$ in the cathode half-shell are reacted therein with HCl to give alkali metal chloride, water and $CO_2$. The $CO_2$ is then sent to the distributor pipe conduit for $CO_2$. The remaining solution is sent to an electrolyte collection apparatus, where it is combined with the dechlorinated anolyte.

The concentration of the combined solution can be adjusted by adding water or alkali metal chloride salt or by means of dilute or concentrated solutions of alkali metal chloride, and then recycled into the anolyte and the catholyte feed to the electrolysis cell.

The anode half-shell and cathode half-shell are appropriately each charged via distributor pipe conduits for the anolyte and catholyte.

The anolyte is guided from the anode half-shell into one or more collection pipe conduits, and the chlorine produced can also be introduced into the collection pipe conduits. Gas and electrolyte are separated in the collection pipe conduit.

The preferred embodiments of the features of the electrolysis apparatus that are utilized in the process, described above for the process of the invention, are also considered, individually or in any combination, to be preferred features for preferred embodiments of the electrolysis apparatus of the invention.

The embodiments of the features of the electrolysis apparatus of the invention that are described above as preferred are likewise considered, individually or in any combination, to be embodiments usable with preference in the above-described process of the invention.

BRIEF DESCRIPTION OF FIGURES

The invention is illustrated in detail by way of example hereinafter with reference to the FIGURES.

The FIGURES show.

Figure 1:
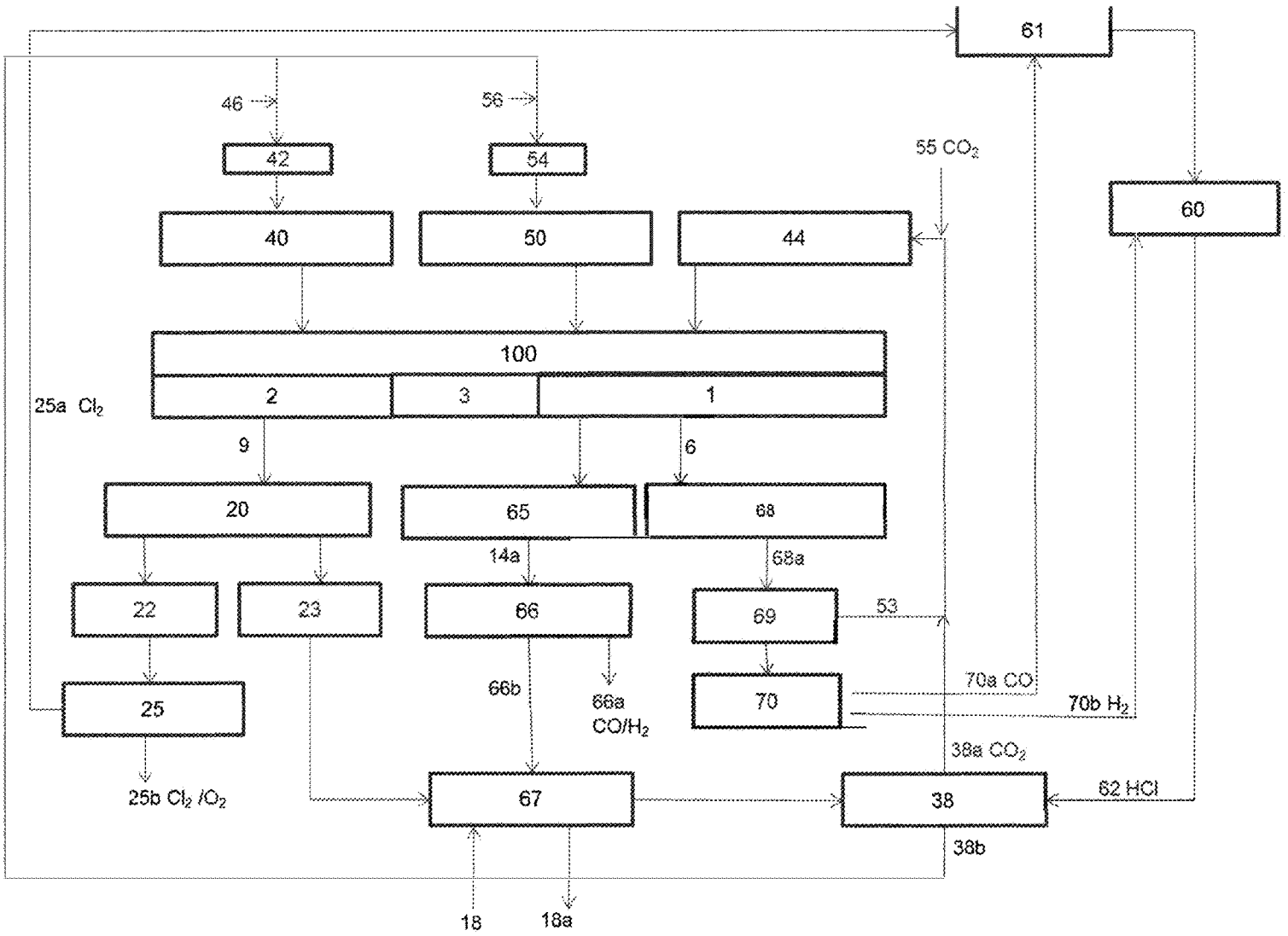
FIG. 1 a schematic overview of the overall process and of the elements of the electrolysis apparatus usable for performance FIG. 2 a schematic vertical cross section through an electrolysis cell Z of the electrolysis apparatus In the FIGURES, reference symbols have the following meaning.

Z electrolysis cell
1 cathode half-shell
2 anode half-shell
3 separator (diaphragm, ion exchange membrane)
4 gas space (cathode)
5 first gas inlet for carbon dioxide (cathode space)
6 first gas outlet for gaseous reaction products (cathode space)
7 second gas outlet for anode reaction product
8 anolyte feed
9 chlorine-containing anolyte output to gas collection pipe conduit 20
10 anode
11 cathode (gas diffusion electrode)
12 catholyte space (electrolyte space)
12*a* catholyte gap (electrolyte space)
13 catholyte feed
14 catholyte drain
14*a* $CO/H_2$-containing catholyte output from collection pipe conduit for catholyte 65 to gas separation unit 66
15 anode space
15*a* anolyte
16 cathode space
17 catholyte
18 feed of water or concentrated or diluted electrolyte for concentration adjustment
18*a* electrolyte discharge
20 collection pipe conduit for anolyte & $Cl_2$ gas mixture
22 $Cl_2$ gas drying
23 anolyte dechlorination
24 flow resistance
25 $Cl_2$—$O_2$ gas separation unit
25*a* cleaned $Cl_2$ gas
25*b* $Cl_2/O_2$ tail gas
31 cathode power lead
32 anode power lead
34 distributor channel
35 electrically conductive top structure
36 elastic electrically conductive connection between GDE 11 and top structure 35
38 carbonate breakdown unit
38*a* conduit for $CO_2$ stream from carbonate breakdown unit
38*b* recycle conduit for alkali metal chloride solution from the carbonate breakdown unit
40 anolyte distributor pipe conduit
42 anolyte heat exchanger
44 distributor pipe conduit for $CO_2$
46 metered addition of acid or base to adjust the anolyte pH
50 catholyte distributor pipe conduit
53 recycle conduit for carbon dioxide gas separated off
54 catholyte heat exchanger
55 carbon dioxide gas source
56 metered addition of acid or base to adjust the catholyte pH
60 isocyanate production
61 phosgene synthesis
62 HCl gas feed
65 catholyte collection pipe conduit
66 $CO/H_2$ gas separation unit
66*a* separated $CO/H_2$ gas from the catholyte from gas separation unit 66
66*b* cleaned catholyte
67 electrolyte collection apparatus
68 collection pipe conduit for $CO/CO_2/H_2$ gas mixture
68*a* mixture of $CO_2$, CO, $H_2$
69 $CO_2$ gas separation for separation of $CO_2$, $H_2$ and unconverted $CO_2$
70 $CO/H_2$ gas separation
70*a* carbon monoxide gas
70*b* hydrogen gas
90 electrically conductive connection of anode to anode half-shell
91 electrically conductive connection of GDE 11, elastic structure 36, electrically conductive top structure 35 to the cathode half-shell 1
100 electrolyzer with electrolysis cells Z (n), n=number of electrolysis cells Z

EXAMPLES

Figure 2:
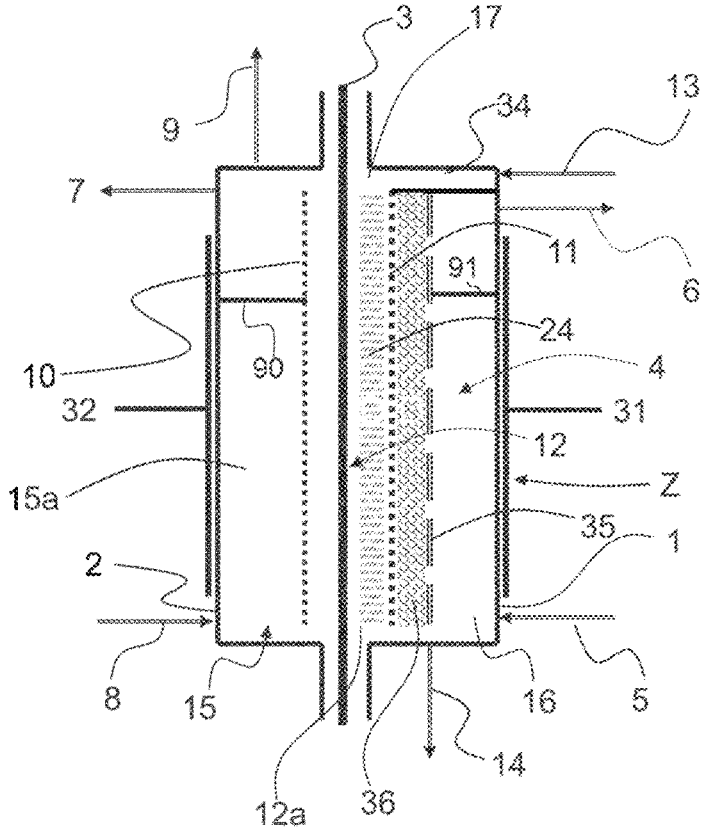

More General Illustrative Description of the Process and the Electrolysis Apparatus An electrolyzer 100 is equipped with a number of 30 to 100 electrolysis cells (Z)—also called electrolysis cells by way of simplification hereinafter—per electrolyzer frame. An electrolysis cell Z (FIG. 2) consists of an anode half-shell 2 and a cathode half-shell 1, and these are separated from one another in each case by an ion exchange membrane 3. The anode half-shell 2 is equipped with an anode 10 having a commercial coating based on a mixed oxide of ruthenium and indium for chlorine production (DSA coating, Denora Deutschland). The cathode 11 is set up as a silver/PTFE-based gas diffusion electrode from Covestro Deutschland AG. The gas diffusion electrode 11 separates the gas space 4 from an electrolyte space 12. The electrolyte space 12 is bounded by the gas diffusion electrode 11 and the ion exchange membrane 3, and forms a gap 12*a*. The gap 12*a* is filled with a PTFE-based fabric 24 that acts as flow resistance for the catholyte 17, which flows from the top downward through the gap 12*a* filled with the fabric 24. The catholyte 17 collects at the base of the cathode half-shell 1 and leaves it via a preferably flexible pipe connection and is guided to a collection pipe conduit (catholyte) 65. In order to prevent gases from leaving the cathode half-shell via the pipe connection, the pipe connection is executed such that it is guided into the collection pipe conduit (catholyte) 65 in an immersed manner.

Anode half-shell 2 and cathode half-shell 1 are separated from one another by a separator 3, an ion exchange membrane 3. It is possible here to use commercial perfluorinated ion exchange membranes of the Asahi Glass F8080 type (manufacturer: Asahi Glass) or Chemours N2050 (manufacturer: Chemours). This prevents the chlorine produced at the cathode 11 from being reduced again and any carbon monoxide produced at the cathode from being oxidized at the anode 10. Likewise prevented here is the mixing of chlorine with hydrogen or CO, which is necessary for safety reasons (risk of hydrogen chloride gas explosion).

Electrical contact in the case of monopolar connection of the electrolysis elements to a DC voltage source (not shown) is from the anode 10 via an electrically conductive connection 90 to the anode half-shell 2, and from the anode half-shell 2 via an anode power lead 32. From the cathode 11, electrical contact is via an elastic electrically conductive mat 36, further via an electrically conductive top structure 35, and further via an electrically conductive connection 91, to the cathode half-shell 1 and thence to the DC voltage source. The gas space 4 of the cathode half-shell 1 is supplied via a distributor pipe conduit 44 with $CO_2$ (see FIG. 1), and then unconverted $CO_2$ and the reaction products from the cathode half-shell 1 are fed via a preferably flexible connection, connected to outlet 6, to a collection pipe conduit 68 for $CO/CO_2$ gas mixture.

The catholyte 14*a* from the collection pipe conduit (catholyte) 65 is sent to a $CO_2/CO/H_2$ gas separation unit 66 in order to separate the still dissolved or dispersed gases such as $CO_2$, CO and any $H_2$ from the catholyte 14*a*. The separation can be effected, for example, by means of a stripping column with the aid of an inert gas. The stripped gas mixture 66*a* (tail gas) is sent, for example, to an incineration. The cleaned catholyte 66*b* is sent to an electrolyte collection apparatus 67 or directly to a carbonate breakdown unit 38.

The gas mixture withdrawn from the gas space 4 of the cathode half-shell 1 is sent to a collection pipe conduit for $CO_2/CO/H_2$ gas mixture 68. Subsequently, excess or unconverted $CO_2$ is separated from the gas mixture ($CO_2$ separation 69). This can be effected, for example, by an amine scrub. The $CO_2$ gas separated off is fed via recycle conduit 53 to the gas space 4 of the cathode half-shell 1, again via the $CO_2$ distributor pipe conduit 44. The $CO_2$ converted is replenished here by an appropriate amount of fresh $CO_2$ from a carbon dioxide gas source 55.

The anode half-shell 2 is supplied with the anolyte 15*a* via a distributor pipe conduit (anolyte) 40. In the anode half-shell 2, chlorine is produced at the anode 10 from an aqueous alkali metal chloride solution. As a side reaction, a small amount of oxygen may be formed as well as the chlorine at the anode. The mixture of $Cl_2$, any $O_2$ and the anolyte is withdrawn from the anode half-shell 2 via outlets 7 and 9 and sent to a collection pipe conduit for anolyte & $Cl_2$ gas mixture 20. The $Cl_2$ still containing oxygen and water vapor is withdrawn from the collection pipe conduit 20, and sent to a $Cl_2$ drying 22, for example by sulfuric acid drying. Depending on the required purity of the chlorine, a further optional purification is connected downstream. For instance, the $Cl_2$ can be sent to the $Cl_2$ gas separation unit 25 in order to separate residues 25*b* of $O_2$ with traces of chlorine. This can be effected, for example, by means of recuperative liquefaction. Thereafter, the chlorine can be compressed and/or liquefied, and/or sent to a chemical synthesis (e.g. phosgene synthesis 61).

A portion of the $Cl_2$ removed, 25*a*, is thus sent to the phosgene synthesis 61 as precursor for isocyanate production 60.

The cleaned anolyte from the collection pipe conduit 20 is sent to a dechlorination unit 23 for removal of compounds in which chlorine is present in an oxidation state greater than zero (active chlorine). This can be effected either by a vacuum dechlorination and/or a chemical dechlorination by addition of an alkali metal-containing bisulfite solution or by addition of hydrogen peroxide. After the dechlorination, the active chlorine content of the anolyte should preferably be less than 20 ppm.

The dechlorinated anolyte is sent to the electrolyte collection apparatus 67. The collected electrolytes in the electrolyte collection apparatus, as well as the alkali metal chloride, contain the alkali metal hydrogencarbonate or carbonate formed, and are sent to the carbonate breakdown unit 38. The carbonate breakdown unit 38 is supplied with hydrogen chloride 62 from isocyanate production 60, with reaction of the hydrogen chloride 62 with the alkali metal carbonate or alkali metal hydrogen carbonate present in the electrolyte to give alkali metal chloride, water and $CO_2$. It is optionally possible to add a stoichiometric excess of hydrogen chloride 62. The separated $CO_2$ is fed back to the gas space 4 of the cathode half-shell together with that from the $CO_2$ separation, the amine scrub 69 and the $CO_2$ to be replenished from a carbon dioxide gas source 55 via the distributor pipe conduit for $CO_2$ 44.

The electrolyte from the carbonate breakdown unit 38 is fed back to the anode half-shell 2 after adjustment of pH by feeding in mineral acid/alkali 46, heating in the heat exchanger 42, via the distributor pipe conduit 40. The temperature of the electrolyte supplied to the anode half-shell is more than 50° C. downstream of the heat exchanger. The pH of the alkali metal chloride solution supplied to the anode half-shell is between 2 and 8; the concentration of alkali metal chloride is 14% by weight to 23% by weight.

In addition, the electrolyte from the $CO_2$ carbonate breakdown unit 38 is fed back to the cathode half-shell 1 via a pH adjustment by feeding in mineral acid/alkali 56 and a heat exchanger 54 via the distributor channel (catholyte) 50. The pH of the electrolyte supplied to the cathode half-shell 1 is between 6 and 14; the temperature is greater than 50° C. The concentration of alkali metal chloride corresponds to that of the electrolyte supplied to the anode half-shell.

The phosgene produced from the phosgene synthesis 61 is used for the production of isocyanates 60, by reacting it with an appropriate, for example aromatic, amine. If the amine is prepared from an aromatic nitro compound, it can be reduced using the hydrogen 70*b* that has been produced in the $CO/H_2$ gas separation 70 and separated off.

A portion of the HCl gas obtained in the isocyanate production 60 is fed to the carbonate breakdown unit 38. The alkali metal carbonate, and possibly also alkali metal hydrogencarbonate, formed by the hydroxide ions formed and $CO_2$ in the cathode half-shell are converted here to alkali metal chloride, water and $CO_2$. The $CO_2$ is sent here to the distributor pipe conduit for $CO_2$ 44.

The concentration of anolyte and catholyte can be adjusted by addition of water or alkali metal chloride salt or by diluted or concentrated salt solutions 18. For avoidance of the accumulation of impurities or of sulfate formed in the dechlorination by addition of bisulfite in the anolyte dechlorination 23, it is possible to dispose of a portion of the electrolyte. This is effected via a disposal conduit 18*a*.

Example (Inventive)

An electrolysis cell Z (see FIG. 2) having an area of 2.5 $m^2$, formed from an anode half-shell 2 and a cathode half-shell 1, is separated by an ion exchange membrane 3 of the Nafion 982 WX type.

The anode 10 consists of expanded titanium metal with a customary coating set up for the preparation of chlorine (with mixed Ru/Ir oxide) for chlorine production from Denora (DSA coating).

The cathode, a gas diffusion electrode (GDE) 11, is installed vertically into the cell Z by the principle of falling-film cell technology, in which the GDE 11 lies on an elastically mounted flow-guiding element 36, which in turn rests on an electrically conductive support structure 35 with openings for access of gas. The GDE 11 is a silver- and PTFE-based GDE on a silver metal mesh from Covestro Deutschland AG (in accordance with published specification EP1728896A2) for chloralkali electrolysis. Between GDE 11 and membrane 3, a PTFE-based two-dimensional fabric 24 was used as flow resistance, through which the catholyte 17 flows from the top downward in free fall.

The current density in electrolysis operation is 3 $kA/m^2$.

The anode space 15 is supplied via a distributor pipe 40 with 229.02 kg/h of an electrolyte (anolyte 15*a*) consisting of 2.68 kg/h of $K_2SO_4$, 45.8 kg/h of KCl and 180.5 kg/h of water with a pH of 7 and a temperature of 80° C. In addition, the chemical dechlorination described below, in steady-state operation of the process, establishes a proportion of 2.68 kg/h $K_2SO_4$ in the anolyte 15*a*.

Withdrawn from the anode space 15 via the outlet 9 are 9.92 kg/h of $Cl_2$ and 0.58 kg/h of $O_2$, and also 193.05 kg/h of electrolyte with 24.9 kg/h of KCl, 10.4 g/h of active chlorine and 165.4 kg/h of $H_2O$ and, in steady-state operation, 2.68 kg/h of $K_2SO_4$, and these are fed to the collection pipe conduit 20.

The electrolyte (spent anolyte) taken from the anode space 15 has a pH of 3.5 and is sent to an anolyte dechlorination 23 which consists, in a first stage, of a vacuum dechlorination, which removes 10.3 g of the $Cl_2$ formed. The spent anolyte thus treated is sent to a second stage of anolyte dechlorination 23 and here to a pH of 9 by addition of 19 g of an 18% by weight potassium hydroxide solution and then sent to a chemical dechlorination in which 0.5 g of a 38% by weight $KHSO_3$ solution is added to the anolyte.

For avoidance of accumulation of $K_2SO_4$ which is formed in the chemical dechlorination of the anolyte, 74.5 g/h of the treated anolyte is discharged (conduit 18*a*) and discarded.

After the chemical dechlorination, the pH of the treated anolyte is lowered to 3.5 by addition of 13.4 g of 18% by weight hydrochloric acid.

The anolyte thus treated can be sent to a storage vessel, the electrolyte collection apparatus 67, or fed directly to the carbonate breakdown unit 38.

The cathode space 16 of the electrolysis cell Z is supplied with 618 kg/h of a catholyte 17 having a temperature of 72° C., consisting of 7.25 kg/h of $K_2SO_4$, 123.6 kg/h of KCl and 487.15 kg/h of $H_2O$. The gas space 4 in the cathode half-shell 1 is supplied with 30.34 kg/h of $CO_2$.

Withdrawn from the cathode space 16 is 651.6 kg/h of catholyte consisting of 123.6 kg/h of KCl, 19.3 kg/h of $K_2CO_3$, 7.25 kg/h of $K_2SO_4$ and 501.4 kg/h of water. The catholyte output had a temperature of 87.3° C.

Additionally withdrawn from the gas space 4 in the cathode half-shell 1 is 22.75 kg/h of gas consisting of 2.66 kg/h of CO, 0.09 kg/h of $H_2$ and 20 kg/h of $CO_2$.

The cathodic conversion of $CO_2$ to CO was 68%.

The anodically produced $Cl_2$ (9.92 kg/h), after drying 22 and removal 25 of $O_2$, together with the CO produced and dried and further CO, was converted to phosgene and sent to isocyanate production 60.

The HCl gas 62 separated from the isocyanate production 60 was sent to the carbonate breakdown unit 38 (10.2 kg/h).

The invention claimed is:

1. A process for preparing carbon monoxide, optionally hydrogen and chlorine by electrochemical reaction of carbon dioxide and alkali metal chloride solution, wherein the carbon dioxide is electrochemically reduced at a gas diffusion electrode as cathode in an aqueous alkali metal chloride-containing solution as catholyte, the catholyte being supplied by a catholyte feed and removed at a catholyte drain, and, at the same time, chlorine is produced anodically from an aqueous alkali metal chloride-containing solution as anolyte (15*a*), the anolyte being supplied by an anolyte feed and removed at an anolyte drain, where the alkali metal salt of carbonic acid formed in the catholyte, selected from alkali metal carbonate, alkali metal hydrogencarbonate or mixtures thereof, is then reacted with hydrogen chloride to give carbon dioxide and alkali metal chloride, and the carbon dioxide (38*a*) released is returned to the cathode space for the gas diffusion electrode and the alkali metal chloride produced is returned either to the anode space and/or to the cathode space, wherein the catholyte drain and the anolyte drain are connected directly or indirectly via pipe conduits to an electrolyte collector, the electrolyte collector is provided via pipe conduit with a carbonate breakdown unit, and the carbonate breakdown unit at least with a recycle line for dissociated carbon dioxide, a controllable feed for hydrogen chloride and a recycle conduit for electrolyte, and the recycle conduit is connected both to the catholyte feed and to the anolyte feed.

2. The process as claimed in claim 1, wherein the hydrogen chloride is taken from a connected process for preparing isocyanates via phosgene as intermediate, and the chlorine formed in the electrochemical reaction is recycled into the phosgene production as precursor for isocyanate production.

3. The process as claimed in claim 1, wherein the hydrogen formed together with CO as optional by-product from the electrochemical reaction is separated from the mixture of hydrogen, CO and $CO_2$ and utilized.

4. The process as claimed in claim 3, wherein the hydrogen is utilized for preparation of diamines as precursor for the isocyanate production process.

5. The process as claimed in claim 1, wherein the alkali metal chloride used for anolyte and catholyte is potassium chloride.

6. The process as claimed in claim 1, wherein the concentration of the alkali metal chloride solution of the anolyte and/or of the catholyte is independently up to 25% by weight.

7. The process as claimed in claim 1, wherein the temperature of the catholyte in the feed to the electrochemical reaction is at least 60° C.

8. The process as claimed in claim 1, wherein the electrochemical conversion of $CO_2$ is conducted on an industrial scale by the membrane electrolysis method at a gas diffusion electrode as cathode.

9. The process as claimed in claim 1, wherein the $CO_2$ is fed to the gas diffusion electrode via a gas space divided from the electrolyte space by the gas diffusion electrode.

10. The process as claimed in claim 9, wherein the gas velocity in the gas space close to the reverse side of the gas diffusion electrode is from 0.001 to 15 m/s.

11. The process as claimed in claim 8, wherein the drift velocity of the catholyte in the interspace between ion exchange membrane and gas diffusion electrode is from 0.8 to 10 cm/s.

12. An electrolysis apparatus for electrochemical conversion of carbon dioxide and alkali metal chloride solution by a process wherein the carbon dioxide is electrochemically reduced at a gas diffusion electrode as cathode in an aqueous alkali metal chloride-containing solution as catholyte and, at the same time, chlorine is produced anodically from an aqueous alkali metal chloride-containing solution as anolyte (15*a*), where the alkali metal salt of carbonic acid formed in the catholyte, selected from alkali metal carbonate, alkali metal hydrogencarbonate or mixtures thereof, is then reacted with hydrogen chloride to give carbon dioxide and alkali metal chloride, and the carbon dioxide (38*a*) released is returned to the cathode space for the gas diffusion electrode and the alkali metal chloride produced is returned either to the anode space and/or to the cathode space, the electrolysis apparatus at least comprising (i) at least one carbon dioxide gas source and (ii) at least one electrolysis cell, at least comprising a cathode half-shell having a cathode, a catholyte feed, a catholyte drain, and a gas space in fluid connection to the carbon dioxide gas source via a first gas inlet, and connected to a first gas outlet for gaseous reaction product-containing gas, further comprising an anode half-shell, wherein the anode half-shell has been provided at least with a second gas outlet for the anode reaction product, an anolyte feed for the introduction of an aqueous alkali metal chloride-containing solution as anolyte and an anolyte drain, and an anode, and a separator disposed between the anode half-shell and cathode half-shell, for separation of anode space and cathode space, further comprising electrical power leads for connection of anode and cathode to a DC voltage source, wherein the cathode is designed as a gas diffusion electrode for conversion of carbon dioxide gas, and cathode, anode and the separator are arranged with their main extent vertically, and a gap as electrolyte space for passage of the catholyte by the principle of a falling liquid film is disposed between separator and cathode, and wherein the catholyte drain and the anolyte drain are connected directly or indirectly via pipe conduits to an electrolyte collector, the electrolyte collector is provided via pipe conduit with a carbonate breakdown unit, and the carbonate breakdown unit at least with a recycle line for dissociated carbon dioxide, a controllable feed for hydrogen chloride and a recycle conduit for electrolyte, and the recycle conduit is connected both to the catholyte feed and to the anolyte feed.

13. The electrolysis apparatus as claimed in claim 12, wherein the separator is an ion exchange membrane or a diaphragm.

14. The electrolysis apparatus as claimed in claim 12, wherein the vertical main extent of the cathode is at least 30 cm.

15. The electrolysis apparatus as claimed in claim 12, wherein the cathode is in a compact design as a gas diffusion electrode based on silver and/or silver oxide, as electrocatalyst and with a pulverulent fluoropolymer, as nonconductive binder on a metallic or nonmetallic, conductive or nonconductive support.

16. The electrolysis apparatus as claimed in claim 12, wherein the first gas outlet is connected at the upper end of the gas space and the second gas outlet at the upper end of the anode space, and the first gas inlet is connected at the lower end of the gas space.

17. The electrolysis apparatus as claimed in claim 12, wherein the second gas outlet for the anode reaction product is connected to a second gas separation unit for separation of oxygen from chlorine from the anode gas.

18. The electrolysis apparatus as claimed in claim 12, wherein the first gas outlet is connected, especially via a collecting conduit, to a first gas separation unit for separation of carbon monoxide, hydrogen and unconsumed carbon dioxide gas.

19. The electrolysis apparatus as claimed in claim 18, wherein the first gas separation unit has a recycle conduit for carbon dioxide gas separated off, connected to the first gas inlet for carbon dioxide gas especially via a distributor pipe conduit.

20. The electrolysis apparatus as claimed in claim 18, wherein the gas separation unit has an outlet for carbon monoxide separated off, connected to a chemical production plant for chemical conversion of carbon monoxide and chlorine to phosgene.

21. The electrolysis apparatus as claimed in claim 12, wherein a flow retarder for the catholyte stream is provided in the gap, where the flow retarder takes the form of an electrically nonconductive, chemically inert textile fabric.

* * * * *